United States Patent [19]

Evans

[11] 3,999,396

[45] Dec. 28, 1976

[54] MARINE PLATFORM ASSEMBLY

[75] Inventor: Darrell Lee Evans, Houston, Tex.

[73] Assignee: James G. Brown & Associates, Inc., Houston, Tex.

[22] Filed: July 18, 1975

[21] Appl. No.: 597,068

Related U.S. Application Data

[63] Continuation of Ser. No. 435,613, Jan. 22, 1974, abandoned.

[52] U.S. Cl. ..... 61/92; 114/77 A

[51] Int. Cl.[2] ..... E02D 21/00; B63B 35/44

[58] Field of Search ..... 61/46.5, 46; 114/.5 D, 114/77

[56] References Cited

UNITED STATES PATENTS

| | | | |
|---|---|---|---|
| 3,183,676 | 5/1965 | Le Tourneau | 61/46.5 |
| 3,466,878 | 9/1969 | Esquillan et al. | 61/46.5 |

OTHER PUBLICATIONS

Oil & Gas Journal of July 22, 1957, p. 62.

*Primary Examiner*—Jacob Shapiro

[57] ABSTRACT

A self-elevating marine platform having a main hull whose length and width dimensions can be readily varied without thereby disturbing the main design of the platform. Added externally to the main hull are at least three auxiliary hulls which are separate and distinct from the main hull. The auxiliary hulls are welded to the port, starboard, and forward ends of the main hull. Each auxiliary hull contains a leg-elevating unit for receiving a leg therein whereby the unit, when energized, will cause the platform to move up or down on the legs which are arranged in a tripod. Each auxiliary hull forms a ballast or preload tank of sufficient volume to exert, when loaded with liquid, all the required mass on its leg.

15 Claims, 8 Drawing Figures

MARINE PLATFORM ASSEMBLY

This is a continuation of application Ser. No. 435,613, filed Jan. 22, 1974, and now abandoned.

BACKGROUND OF THE INVENTION

Self-elevating marine platforms are used primarily for oil well drilling or production. Despite the many platforms that have been designed over the years, and the general similarity of various spaces, decks, tanks and their locations, the known platforms have certain limitations, chief among which are: (1) after one platform has been designed and constructed, the dimensions for the next contemplated platform cannot be readily varied, without essentially redesigning the first platform; (2) the preload tanks form integral part with the main hull thereby unduly limiting the choices of available deck space for quarters, machinery and cargo; (3) known platform designs do not readily end themselves to modular construction for economic fabrication and to take advantage of shipyard availability; and (4) the location of the preload tanks precludes them from exerting optimum load during use and stability during tow.

The art of designing jackup platforms to meet the requirements laid down by the prospective owners and operators of such platforms is widely known. However, the known designs are limited to individual platforms and do not readily lend themselves to dimensional variations so as to take full advantage of the known designs.

To carry out the design operations systematically, the hull of a platform is divided into transverse frames. The volume between each pair of adjacent frames is called a "segment." The volume of each segment is computed together with the position of its center of volume. There may be more or less than 40 such segments for a typical platform.

To design a platform hull, it is necessary to maintain a running check of the segments' estimated weights and calculated bouyancy forces, and to keep track of the products of these weights and forces times the horizontal fore-and-aft distances or "moment arms." These products are known as the longitudinal weight and bouyancy moments. The forward-and-after moments of each segment are then computed in the same way as the fore-and-aft moments. The fore-and-aft positions of the centers of gravity of the individual segments are then estimated relative to a plane passing through the platform's mid-length. Separate sums are kept of the moments of these groups forward of and abaft the mid-length.

For the platform to float at a level attitude, the center of gravity and the center of bouyancy must lie in the same vertical transverse plane. It is possible to balance the weight between the platform's ballast tanks, which can be the preload tanks, until the desired attitude is attained. Such balancing, however, with prior art platforms is not easily attainable, especially if after the platform is built, the actual weights and volumes, or their centers do not agree exactly with the estimated values, as some machinery may have been added during the construction period.

The vertical position of the center of gravity is important in predicting the stability and behavior of a fully-jacked-up platform at sea under rough storm and wave conditions. This position may change by many feet depending upon the nature, amount, and disposition of the cargo and machinery. When the platform is elevated high out of water, it is at a disadvantage in winds and waves. It needs added mass to help it remain through waves and to reduce its tendency to overturn. Each preload tank is used to increase the total mass on the platform's legs and to place the center of gravity in a more advantageous position.

On the other hand, while being towed, the preload tanks become ballast tanks to help stabilize the platform in a seaway. The tanks can be filled with fresh water, or sea water and can be easily emptied when the weight is no longer desired. It is also desirable to have crew accomodations below the main deck. The main deck can then be used for cargo and machinery; and services and living quarters can be arranged in regions clear of preload tanks and cargo-handling areas.

Thus the arrangement, the disposition and the proportions of the structual materials in the hull, all known as the "configuration," are most important features.

When the structural configuration has been selected, conforming satisfactorily to the platform arrangement, the designer will select the scantlings, defined as the size, shape, area, and unit weight of the individual structural members. The preliminary scantlings are chosen from experience, from a platform generally similar, from classification society rules, or by an analytic process.

A platform hull with a deck, resists vertical and lateral bending and twisting all at the same time. Since some portions of the hull are in compression and shear from bending and twisting, the relatively thin bottom sides and deck must be prevented from buckling, crumpling, and wrinkling when the hull is strained. This is accomplished by the bulkheads which are reinforced with transverse and longitudinal stiffeners. The transverse and longitudinal bulkheads required for service, access, and storage, and the boundaries of internal tanks for liquids are utilized for structural strength wherever practicable.

SUMMARY OF THE INVENTION

In accordance with a broad aspect of the present invention, there is provided a self-elevating platform assembly for offshore work which comprises a main hull, having a plurality of longitudinal and transverse bulkheads which divide the main hull into rectangular sections. The main hull is welded to separate, watertight, port, starboard, and forward auxiliary hulls. Each auxiliary hull supports a leg-elevating unit for receiving a leg therein for jacking the platform.

Each auxiliary hull forms a preload tank whose capability is adequate to fully preload its leg.

BRIEF DESCRIPTION OF THE DRAWINGS

To facilitate the understanding of the drawings, the same numerals will be used throughout the figures to designate the same or similar parts.

The platform assembly in accordance with the present invention is generally designated as 10. It includes a main hull 11 and three separate and distinct auxiliary hulls 12–14 welded to the main hull at its port, starboard and forward sides. Each auxiliary hull forms a spud well 15 for accepting an elevating unit 16 adapted to receive therein a spud or leg 17. Hulls 12–14 form preload tanks 12'–14', respectively.

Figure 1:
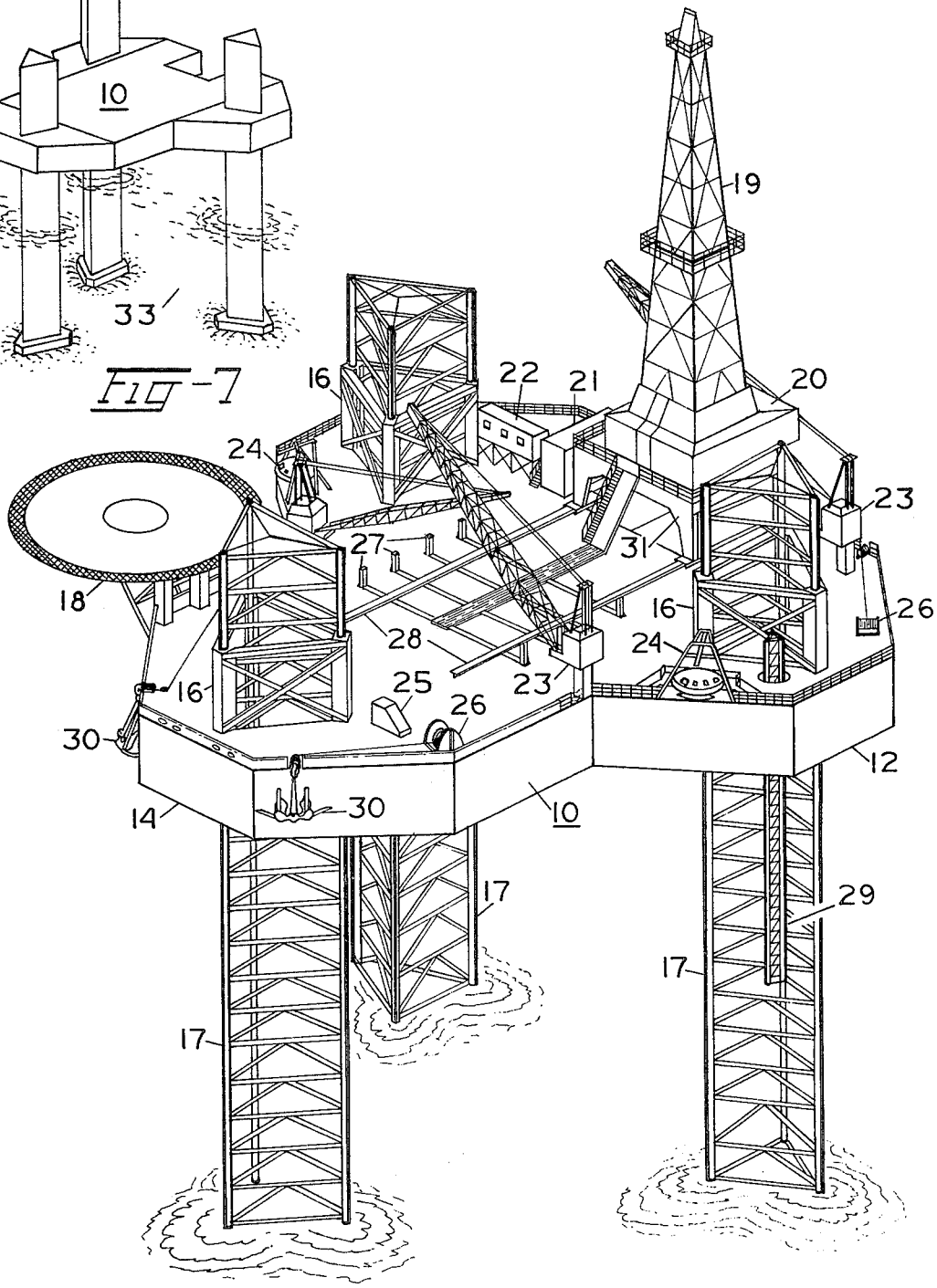
FIG. 1 is a view in perspective of a working platform embodying the present invention.
Figure 2:
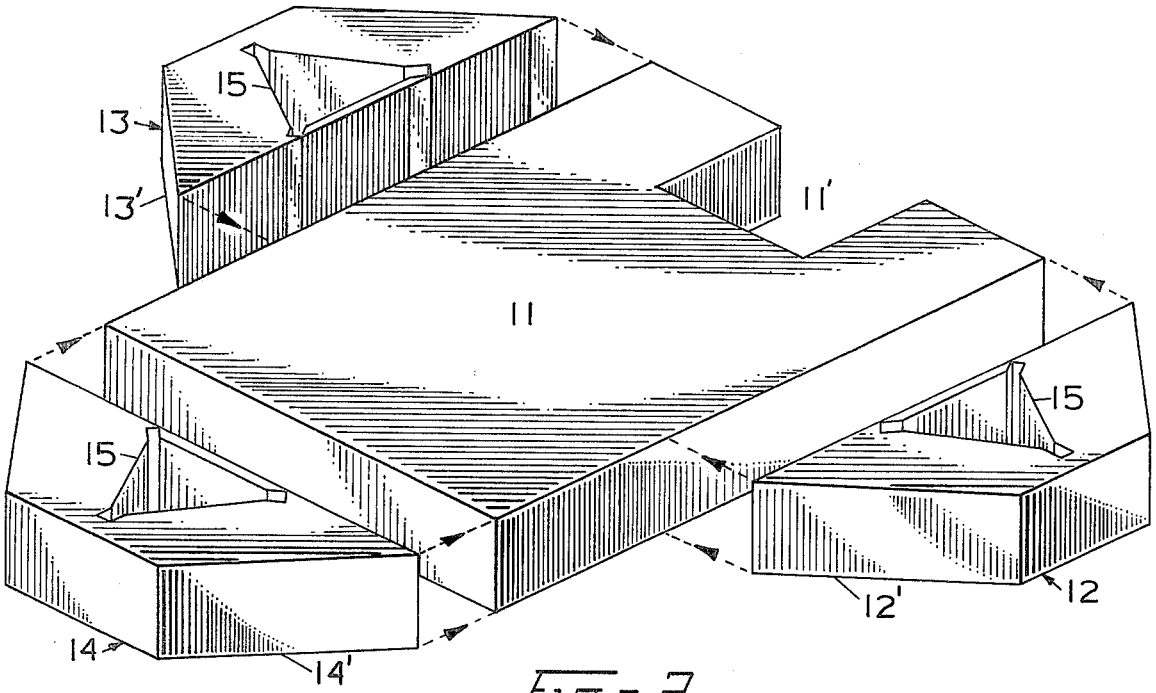
FIG. 2 is a view in perspective illustrating the auxiliary hulls prior to their becoming welded to the main hull.

Platform assembly 10 is illustrated in FIG. 1 for offshore oil well drilling or production. For such work it would typically include: a helliport 18, a derrick 19, drawworks 20, a shell shaker house 21, a mud logging trailer 22, a pedestal crane 23, a survival capsule 24, a booby hatch 25, an anchor winch 26, and pipe rack 27, a skid rail 28, a raw water tower 29, an anchor rack assembly 30, and a crawler 31. Of course, the kind of equipment and machinery carried by platform assembly 10 will vary depending upon the nature of the work performed on or around the platform.

With particular reference now to FIGS. 1–5, the main hull 11 has a generally rectangular cross-sectional area, the aft end of which defines a slot 11', as is conventional with such platforms. The principal stress-carrying members of main hull 11 are longitudinal bulkheads 40 and transverse bulkheads 41. The number of bulkheads provided will depend on the length and breadth of the platform. These bulkheads divide the main hull 11 into rectangular modules.

In each auxiliary hull, the longitudinal and transverse bulkheads are designated as 42 and 43, respectively.

Computer programs can be devised for the configuration shown in FIG. 1, defined by its principal characteristics: length, breadth, decks, and hull coefficients. The design will meet the stated requirements regarding cargo capacity and dead weight, and these requirements provide the basis for a series of equations for the computer to solve. The equations cover weight and displacement, hull volumes, stability, and sea-keeping performance. They also incorporate a vast amount of empirical data on weights, volume, resistance, etc. From the design and configuration of one platform, sketches can be prepared for another platform of the same design but on different numerical characteristics.

Contract plans can readily be modified for different platform dimensions and these will be sufficiently complete and comprehensive to enable the platform builders to make estimates of cost and time of construction. There will be enough information at hand to enable the platform builders to draw the working plans, to fabricate the parts, and to build the platform in accordance with the wishes of the prospective owner and the naval architect of the platform.

Figure 8:
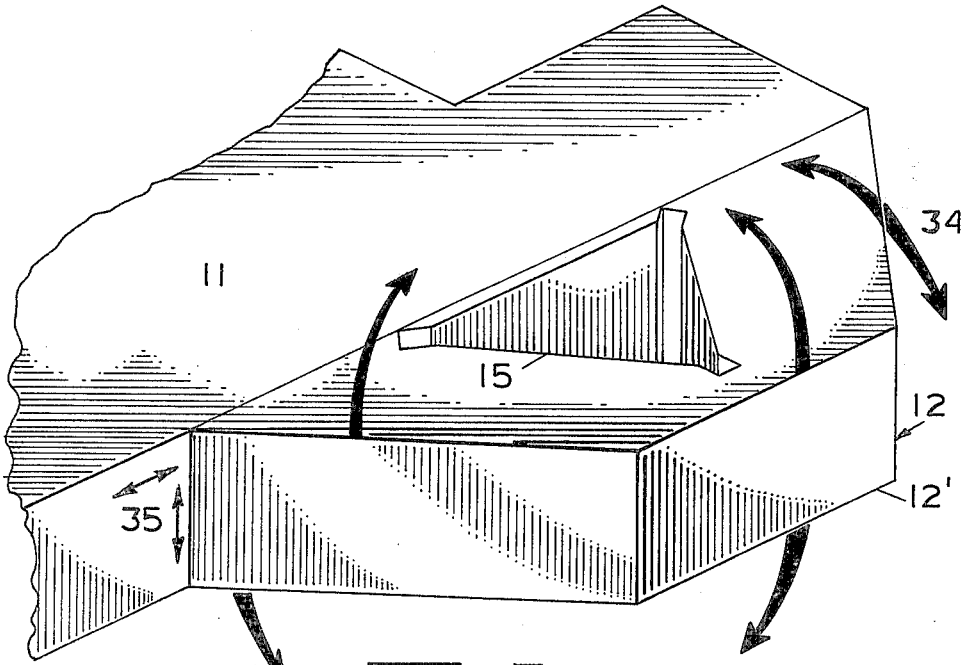
FIG. 8 is a partial perspective view illustrating certain forces acting on the platform assembly.
Figure 3:
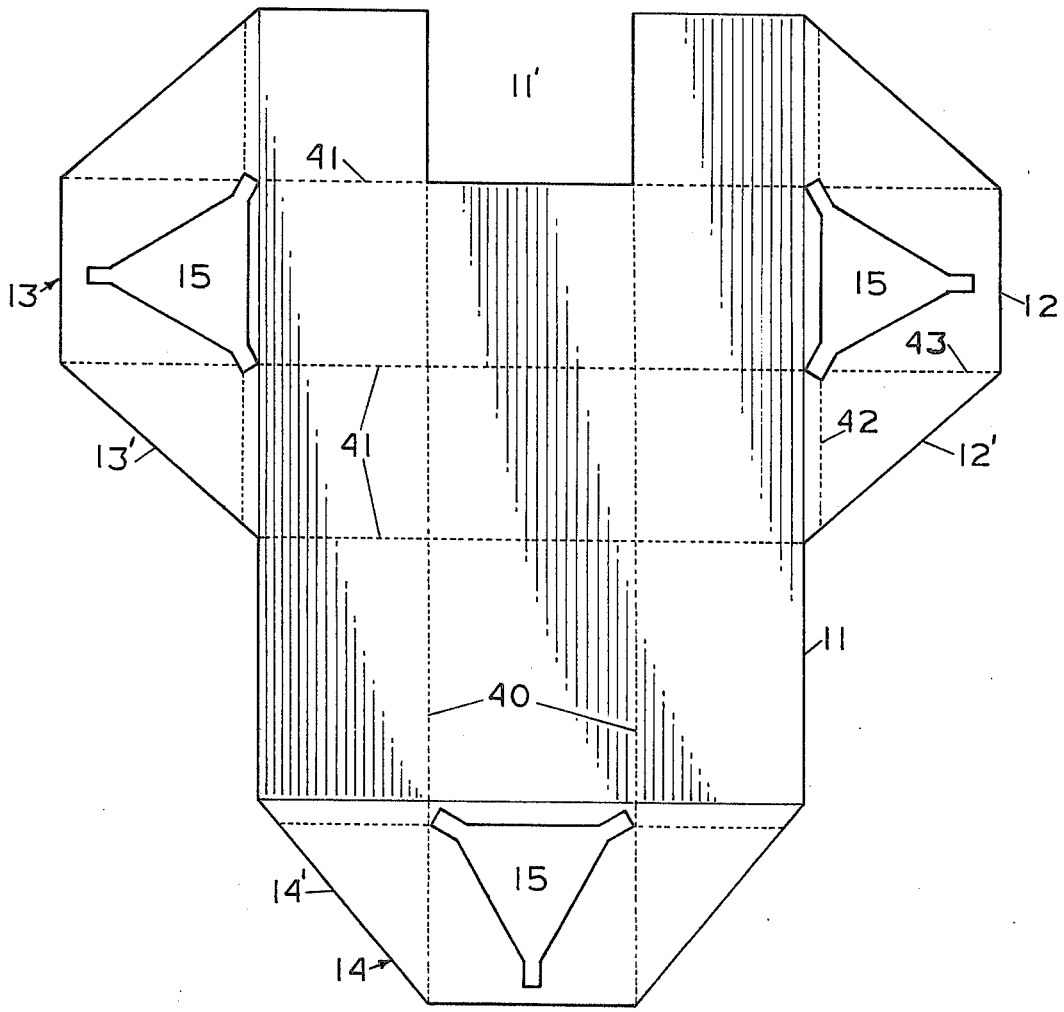
FIG. 3 is a top view of the platform assembly after the auxiliary hulls are welded to the main hull.
Figure 4:
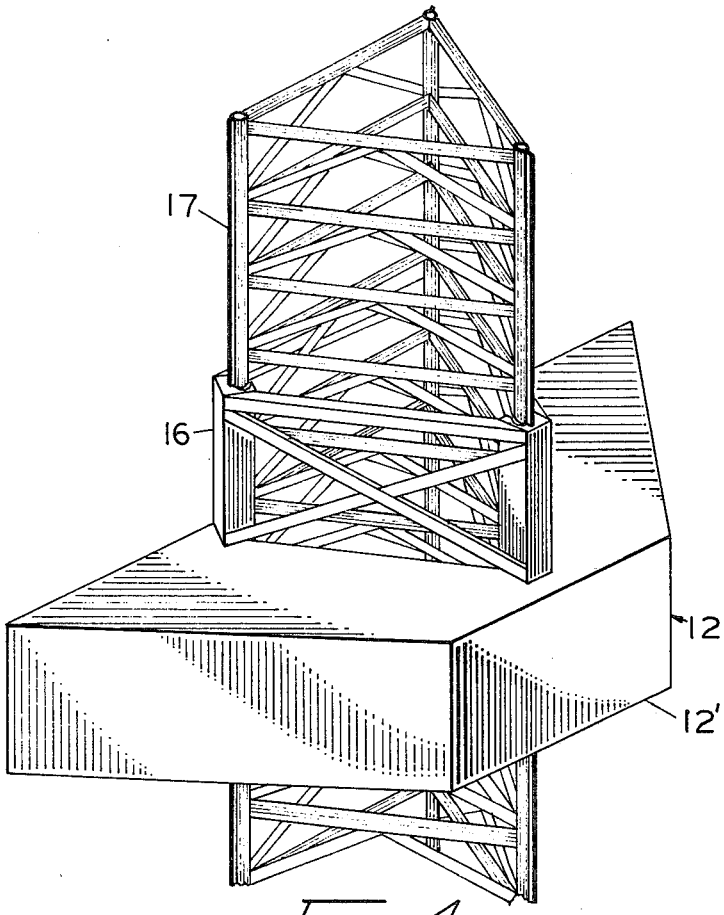
FIG. 4 is a view in perspective of one auxiliary hull with its leg and elevating unit.

Once an analysis has been made of how the various parts are strained, as by the bending moments 34 and shear forces 35 (FIG. 8), of how the applied loads are distributed among the various bulkheads, and of how all of them work together the same analysis will apply for the next platform which differs from the first platform only in its rectangular dimensions.

Figure 7:
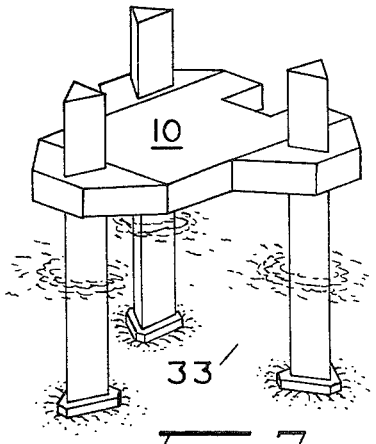
FIG. 7 illustrates the platform assembly standing on the ocean floor.

The maximum forces that a platform assembly 10 is likely to encounter in service, as when it legs 17 are embedded in the sea floor 33 (FIG. 7), are the weight, inertia, and hydrodynamic forces caused by gravity and by the sea wave motions. The moments of greatest interest are the maximum bending moments 34 in all planes.

Thus in accordance with an important aspect of the present invention, once the hulls' design has been programed either in equation form or computer program, hulls of different dimensions can be readily designed without affecting the basic design programs, or equations, that is, the new desired dimensions are inserted into the old programs or equations to arrive at the desired construction specifications.

The design of the platform in accordance with the present invention allows the capability of changing the dimensions of the main hull without changing the configuration of the auxiliary hulls. Also, the same mode of construction of the main hull can be used for hulls of different length and breadth dimensions. The design program or equations of the main hull need not be modified since the loads will be carried by the bulkheads the same way.

Moreover, by making the main and auxiliary hulls watertight, the can be fabricated at different locations by shipyards having different skills. Thus, the auxiliary hulls with their elevating units can be fabricated in a shipyard having greater expertise than the shipyard fabricating the main hull. Such construction versatility can considerably reduce the overall cost of fabricating the entire platform assembly 10.

Also, since the auxiliary hulls are farther removed from the center of gravity of the main hull, they allow better control of the assembly's centers of gravity and bouyancy, as well as provide improved stability during tow.

Figure 5:
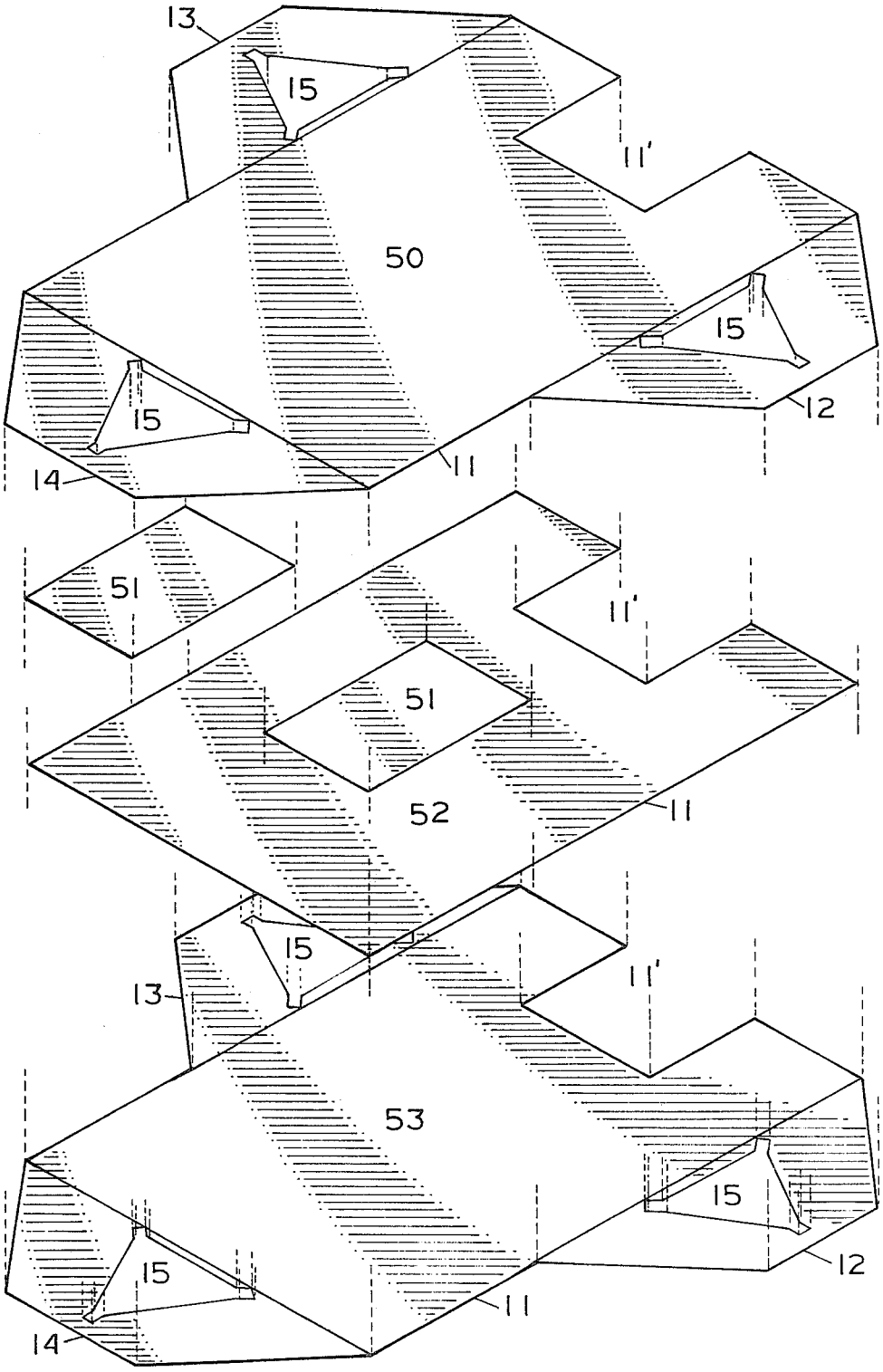
FIG. 5 is an exploded view of the deck's arrangement.

In the exploded view of FIG. 5, there is shown a main deck 50, an upper quarters deck 51, a machinery-and-lower quarters deck 52, and a bottom-plating deck 53.

It will be appreciated that the deck arrangement of the main hull 11 can lend itself to a variety of deck combinations for cargo, machinery and crew accomodations.

The cross-sectional area of each auxiliary hull is shown as being trapezoidal. It will be appreciated that it could be semi-circular or any cross-sectional area between trapezoidal and circular such as hyperbolic and parabolic. A trapezoid, however, is easiest to construct as between the other practical choices available.

Each of preload tanks 12'–14' provides full preload capability on its leg 17, and affording full control of the longitudinal, transverse and vertical centers of gravity.

Figure 6:
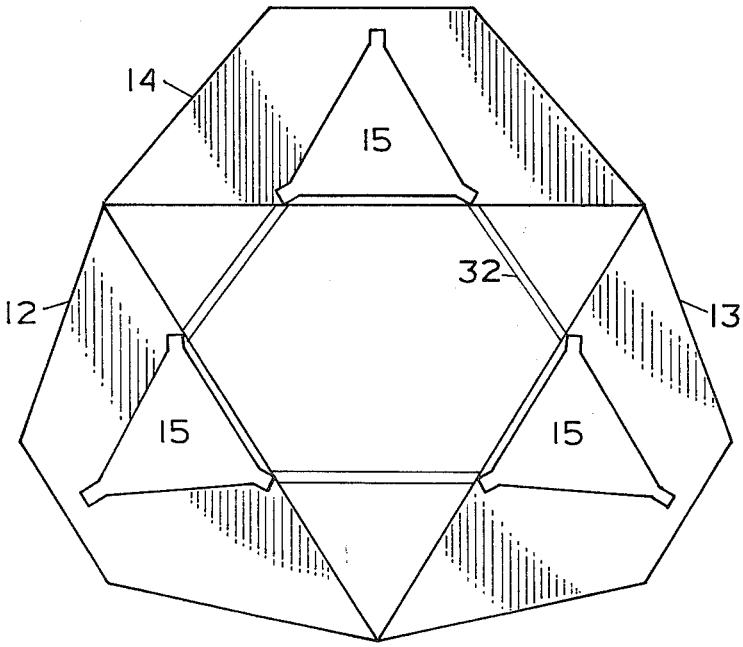
FIG. 6 illustrates the manner of interconnecting the three auxiliary hulls for the purpose of towing them together to the final assembly site.

Since the main hull 11 and the auxiliary hulls 12–14 are watertight, the auxiliary hulls can be connected by connectors 32 and towed together, as illustrated in FIG. 6, to the final erection site. Thus, one shipyard can construct the main hull and another shipyard with greater expertise can construct the auxiliary hulls. Prior to welding, the edges of the auxiliary hulls can be trimmed down to bring about a perfect alignment with the walls of the main hull within tolerances required by the welding process employed.

Thus, each auxiliary hull never ceases to define a watertight preload tank whose vertical walls extend between the bottom-plating deck and the main deck. The volume capacity of each of preload tanks 12'–14' is selected so that the tank can exert the maximum anticipated or required preload on its leg 17. In this fashion, the need for smaller preload tanks within the main hull is completely avoided.

The positioning of the preload tanks 12'–14' outside the main hull makes all places in the hull accessible. Thus in accordance with this invention, cargo, machinery, and useful load can be placed on any deck of the main hull.

This invention allows to take advantage of the best methods of fabricating parts and joining them, and to estimate and predict the final performance of the platform assembly and all of its parts. It allows the use of one design for multi-dimensional structures.

What is claimed is:

1. A self-elevating marine platform for use in positioning work equipment over a body of water at an offshore well, said platform comprising:

a. a main structure having a top surface, a bottom surface, and a plurality of side walls forming with the top and bottom surfaces an enclosed, water-tight, main hull constructed to carry cargo, machinery and personnel;

b. a plurality of auxiliary hulls disposed, in horizontal, spaced-apart relationship, outwardly from and rigidly secured to said main hull, c. each auxiliary hull including:

a. a top plate having an opening, a bottom plate having an opposite opening, a plurality of side walls between said top and bottom plates adapted to form (1) a spud well in and through said openings, and (2) a large-volume, water-tight, preload tank around said spud well, and b. a spud-elevating unit mounted in said spud well.

2. The platform of claim 1 wherein the preload tanks in said plurality of auxiliary hulls have a combined volume which provides, when the tanks are flooded, a preload on said platform.

3. The platform of claim 2, wherein said preload is sufficient to provide substantially all the required preload on said platform.

4. The platform of claim 2 wherein one sidewall of each auxiliary hull is welded to an opposite sidewall of said main hull.

5. The platform of claim 4 wherein said top and bottom surfaces of said main hull are substantially rectangular and each sidewall of said main hull is substantially rectangular in elevation view.

6. The platform of claim 4 wherein at least three sidewalls of said auxiliary hulls are welded to the port, starboard and forward ends of said main hull.

7. The platform of claim 5 wherein the aft end of said main hull defines an opening having a rectangular cross-sectional area.

8. The platform of claim 6 wherein each one of said three sidewalls extends between said top and bottom surfaces of said main hull.

9. The platform of claim 1 wherein each auxiliary hull has a trapezoidal configuration in plan view, and said main hull has a substantially-rectangular, cross-sectional area in plan view defining a rectangular slot therein.

10. The platform of claim 9 wherein said main hull includes between said top and bottom surfaces a main deck, a quarters deck, a machinery deck, and a bottom-plating deck.

11. A self-elevating marine platform adapted for oil well drilling and production, comprising:

a main hull constructed to carry cargo, machinery, and living quarters above a body of water at an offshore well;

a number of horizontally-spaced apart auxiliary hulls, each auxiliary hull being disposed entirely outside of and welded to the main hull, each auxiliary hull having sufficiently large cross-sectional dimensions to form therein: a vertically-extending well and a large-volume, water-tight tank around said well, each tank being adapted to be flooded with water, each well containing an elevator movably receiving therein a spud tower which vertically extends to the sea floor, whereby said platform can be vertically moved up or down on said tower; and all of said tanks, when flooded, in all of said auxiliary hulls having a combined volume which is adequate to provide substantially all of the required preload for said platform when the platform is fully elevated above said body of water.

12. The platform of claim 11 wherein said main hull carrying a plurality of decks, the top and bottom decks of said main hull and the sidewalls between said decks being substantially rectangular.

13. The platform of claim 13 wherein the number of auxiliary hulls is at least three: a first auxiliary hull is welded to the port end, a second auxiliary hull is welded to the starboard end, and a third auxiliary hull is welded to the forward end of said main hull.

14. A self-elevating marine platform for use in positioning work equipment over a body of water at an offshore well, said platform comprising:

a main structure having a top surface, a bottom surface, a plurality of sidewalls forming with the top and bottom surfaces an enclosed, water-tight, main hull constructed to carry cargo, machinery and personnel; and a plurality of stabilizing the structures disposed, in horizontal, spaced-apart relationship, outwardly from and rigidly secured to said main hull, each stabilizing structure including a top surface and a bottom surface, each surface having a large opening therein forming a spud well having a spud-elevating unit for movably receiving therein a permanent vertical spud tower whose length is greater than the depth of the body of water, said platform being movable up or down on said spud tower; sidewalls forming with said top and bottom surfaces a large, water-tight, hollow preload hull;

said main structure providing part of the preload on the spuds; and said preload hulls having a volumetric capacity sufficient to provide the remaining preload on the spud towers.

15. A self-elevating platform assembly for offshore work comprising:

a main hull, drilling equipment and quarters on said main hull, at least three auxiliary water-tight hulls spaced around and rigidly affixed to the main hull, each auxiliary hull comprising:

a spud well having a tower elevating unit therein, and a preload tank having capacity for ballast and means for adding and removing ballast, said means being operable separately for each preload tank so that by variation of the ballast in the preload tanks the center of buoyancy and center of gravity of the platform and the preload on each tower can be adjusted.

* * * * *